US005577154A

United States Patent [19]

Orton

[11] Patent Number: 5,577,154

[45] Date of Patent: Nov. 19, 1996

[54] RADIO CONTROLLED MODEL CONTROL SYSTEM WITH NONLINEAR TRIGGER-TO-CONTROLLER-OUTPUT RESPONSE

[76] Inventor: Kevin R. Orton, 940 Calle Negocio, San Clemente, Calif. 92673

[21] Appl. No.: 390,494

[22] Filed: Feb. 17, 1995

[51] Int. Cl.[6] ..... H02P 7/00

[52] U.S. Cl. ..... 388/811; 318/16; 318/269; 446/456

[58] Field of Search ..... 388/804, 811, 388/817, 827, 829; 318/16, 625, 628, 55, 56, 269, 549, 551; 180/271, 275, 320, 325, 333, 907; 340/446, 447; 446/454, 456

[56] References Cited

U.S. PATENT DOCUMENTS

| | | | |
|---|---|---|---|
| 4,415,049 | 11/1983 | Wereb | 180/907 |
| 4,467,954 | 10/1984 | Johnson et al. | 318/628 |
| 4,511,825 | 4/1985 | Klimo | 318/67 |
| 4,634,941 | 1/1987 | Klimo | 318/139 |
| 5,043,640 | 8/1991 | Orton | 318/16 |
| 5,136,452 | 8/1992 | Orton | 318/16 X |
| 5,216,337 | 6/1993 | Orton et al. | 318/16 |

*Primary Examiner*—Jonathan Wysocki
*Attorney, Agent, or Firm*—Loyal M. Hanson

[57] ABSTRACT

A control system for a radio controlled model includes an onboard speed controller, an onboard receiver, and a separate transmitter unit having a throttle/brake trigger or other manually moveable member that an operator can move from a neutral position over a range of speed setpoint positions and a range of braking setpoint positions in order to input speed and braking setpoint information. At least one of the speed controller, the receiver, and the transmitter unit is programmed or otherwise arranged to produce a nonlinear speed controller response such that (i) the speed controller responds to an incremental increase in speed setpoint position of the moveable member near the neutral position with a smaller incremental increase in drive circuit duty ratio than when the speed controller responds to such an incremental increase in speed setpoint position near a MAXIMUM speed setpoint position (i.e., less throttle sensitivity near neutral), and (ii) the speed controller responds to an incremental increase in braking setpoint position of the moveable member near the neutral position with a greater incremental increase in brake circuit duty ratio than when the speed controller responds to such an incremental increase in braking setpoint position near a MAXIMUM braking setpoint position (i.e., more brake sensitivity near neutral).

11 Claims, 4 Drawing Sheets

RADIO CONTROLLED MODEL CONTROL SYSTEM WITH NONLINEAR TRIGGER-TO-CONTROLLER-OUTPUT RESPONSE

BACKGROUND OF THE INVENTION

1. Technical Field

This invention relates generally to radio controlled (R/C) models, and more particularly to a control system enabling more effective operator control of the R/C model's drive motor.

2. Description of Related Art

The battery powered drive motor of a conventional R/C model operates under control of an R/C model control system. The control system includes an onboard speed control module (or speed controller), a miniature onboard receiver, and a separate handheld transmitter unit. An R/C enthusiast manipulates a throttle/brake trigger on the transmitter unit to input speed and braking setpoint information, the transmitter unit communicates that information to the speed controller via the onboard receiver, and the speed controller controls the drive motor accordingly.

A typical throttle/brake trigger (or other moveable member for inputting speed and braking setpoint information) normally occupies a neutral position representing zero speed and no braking. Pulling the trigger from the neutral position in a first direction increases motor speed and pushing it from neutral in a second direction increases braking. The operator simply places a finger through a loop in the trigger, pulls on it to increase speed, and pushes on it to increase braking.

Different positions in the first direction (the throttle side of neutral) represent different speed setpoints for different drive motor speeds, increasing from little speed at an initial setpoint position nearest the neutral position to maximum speed at a maximum-speed setpoint position furthest the neutral position. Similarly, different trigger positions in the second direction (the brake side of neutral) produce different braking setpoints representing different braking rates, increasing from little braking at an initial-braking setpoint position nearest the neutral position to maximum braking at a maximum-braking setpoint position of the trigger furthest the neutral position. So, by skillfully pushing and pulling on the trigger, the operator can control the motor with sufficient finesse to undertake complex maneuvers with the R/C model and even successfully engage in racing activities.

However, existing control systems produce an uneven drive motor response to trigger movement. On the throttle side of neutral, incremental changes in trigger position near neutral (low speeds) cause greater changes in motor speed than do similar changes in trigger position near the maximum-speed position (high speeds). In other words, the drive motor is very sensitive to trigger operation near the neutral position and less sensitive near the maximum-speed setpoint position.

Conversely, an incremental change in trigger position near the neutral position on the brake side of neutral produces a smaller change in braking than it does near the maximum-braking setpoint position. The trigger is less sensitive to trigger operation near the neutral position and more sensitive near the maximum-braking setpoint position.

R/C drive motor response at various speeds to a step response in excitation can cause those characteristics. They frustrate operation because the operator must continually compensate for trigger sensitivity according to trigger position while rapidly pushing and pulling on the trigger (e.g., 3 to 4 times per second). Failure to properly compensate can result in the drive wheels of the model spinning from too much forward torque when the operator pulls on the trigger to increase speed and locking from too much reverse torque when the operator pushes on the trigger to increase braking. Such undesired drive wheel responses can significantly impair maneuverability and even lose the race, and. existing control systems fail to account for drive motor characteristics resulting in such uneven throttle/brake trigger sensitivity. As a result, operators need an R/C model control system with improved control characteristics.

SUMMARY OF THE INVENTION

This invention solves the problems outlined above by providing an R/C model control system with a nonlinear trigger-to-controller-output response that compensates for the characteristics of the drive motor. The control system decreases sensitivity to changes in speed setpoint position of the throttle/brake trigger near the neutral position while increasing sensitivity to changes in braking setpoint position near neutral. That is accomplished by arranging at least one of the transmitter, the receiver, and the speed controller so that the overall trigger-to-drive-motor-output response is more linear than is common with existing control systems.

As a result, the operator need not continually compensate for trigger sensitivity as he rapidly pulls and pushes on the throttle/brake trigger. He is less likely to spin the wheels while increasing speed. He is less likely to lock the wheels during braking. And speed changes become more linearly related to trigger movement for improved maneuverability.

To paraphrase some of the claim language subsequently presented, a control system for a radio controlled model constructed according to the invention includes a speed controller, a receiver, and a transmitter unit. The speed controller is adapted to be mounted on an R/C model and it includes a drive circuit operable at a variable drive circuit duty ratio for controlling the speed of a drive motor of the model. It also includes a brake circuit operable at a variable brake circuit duty ratio for controlling the braking rate of the model, as well as including a control circuitry for changing the drive circuit duty ratio and the brake circuit duty ratio according to speed and braking information sent to the speed controller. The receiver is also adapted to be mounted on the radio controlled model and operationally interconnected with the speed controller. There, it receives speed and braking information from the transmitter unit and sends corresponding speed and braking information to the speed controller.

The transmitter unit transmits speed and braking information to the receiver. It includes a throttle/brake trigger or other manually moveable member for enabling an operator to input speed and braking information to the transmitter unit. The moveable member can be moved on a first or throttle side of a neutral position of the moveable member through a range of speed setpoint positions, from an INITIAL speed setpoint position of the moveable member slightly off the neutral position to a SECOND speed setpoint position just beyond the INITIAL position, and then through a series of INTERMEDIATE speed setpoint positions still further from the neutral position, to a MAXIMUM speed setpoint position furthest the neutral position. The moveable member can also be moved on a second or brake side of the neutral position through a range of braking setpoint positions, from an INITIAL braking setpoint position of the moveable member slightly off the neutral position to a SECOND braking setpoint position just beyond the INITIAL braking setpoint position, and then through a series of INTERMEDIATE braking setpoint positions still further from the neutral position, to a MAXIMUM braking setpoint position furthest the neutral position.

According to a major aspect of the invention, at least one of the speed controller, the receiver, and the transmitter unit is arranged to produce a nonlinear speed controller response to changes in the position of the moveable member. Preferably, the speed controller includes microprocessor circuitry that is programmed to produce the nonlinear speed controller response, although it may be achieved by suitably configuring any one or more of the control system components so that (i) the speed controller responds to an incremental increase in speed setpoint position of the moveable member near the neutral position with a smaller incremental increase in drive circuit duty ratio than when the speed controller responds to such an incremental increase in speed setpoint position near the MAXIMUM speed setpoint position (i.e., less throttle sensitivity near neutral), and (ii) the speed controller responds to an incremental increase in braking setpoint position of the moveable member near the neutral position with a greater incremental increase in brake circuit duty ratio than when the speed controller responds to such an incremental increase in braking setpoint position near the MAXIMUM braking setpoint position (i.e., more brake sensitivity near neutral).

Stated in terms of the method employed, a method of controlling the speed and braking of a drive motor of a radio controlled model includes the step of providing a control system having a speed controller, a receiver, and a transmitter unit as described above. The transmitter unit includes a moveable member as described above and the speed controller includes a drive circuit, a brake circuit, and a control circuit as described above. The method proceeds by at least partially compensating for the characteristics of the drive motor with the control system by varying the drive circuit duty cycle and the brake circuit duty cycle in manner producing the desired nonlinear response to movement of the moveable member.

Thus, the invention overcomes the throttle/brake trigger response problem of existing R/C model control systems to enable far better operator control. The foregoing and subsequent descriptions combine with available literature and known techniques to enable one of ordinary skill in the art to suitably configure components of the control system without undue or unreasonable work or experimentation. The following illustrative drawings and detailed description make the foregoing and other objects, features, and advantages of the invention more apparent.

DESCRIPTION OF A PREFERRED EMBODIMENT

Figure 1:
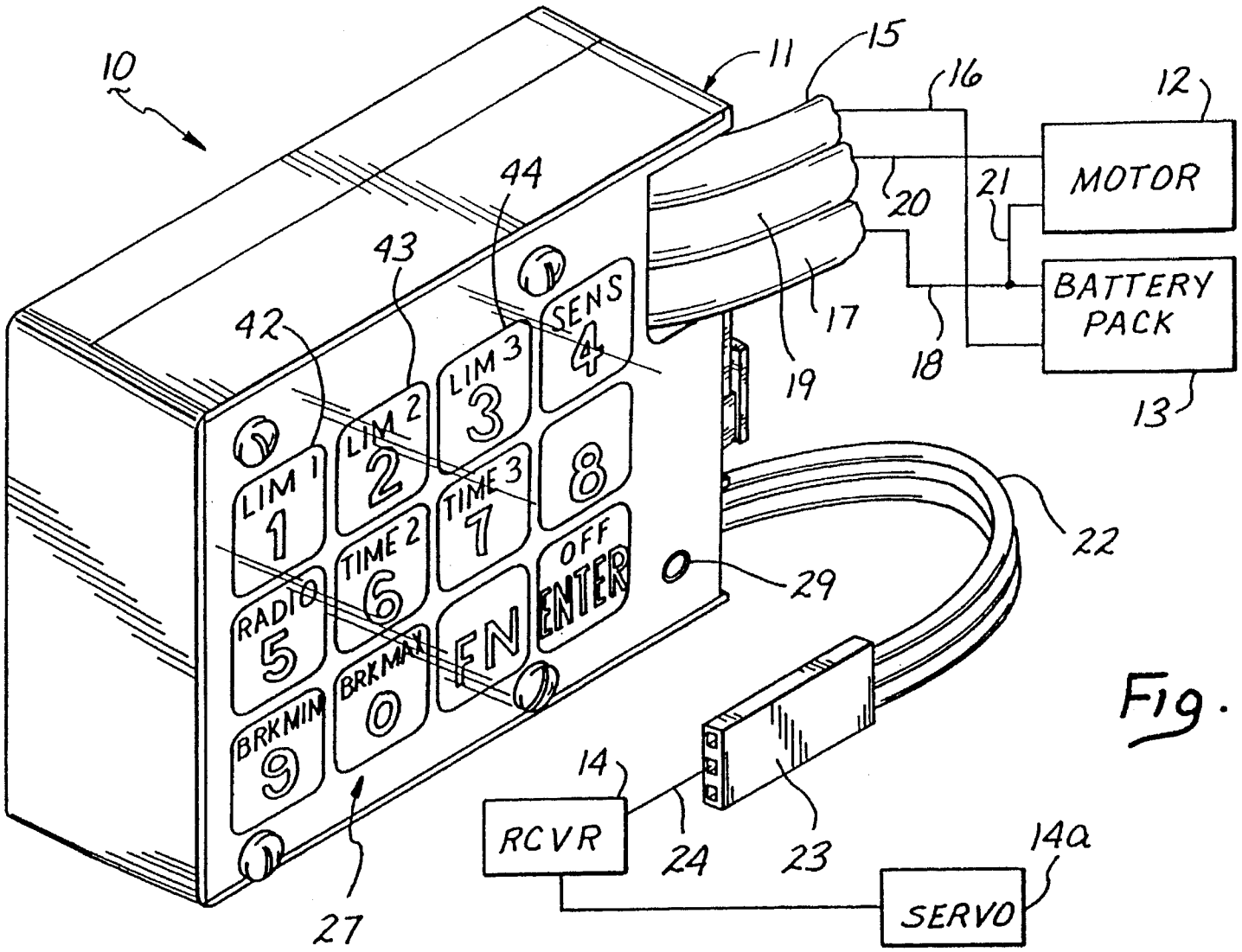
FIG. 1 of the drawings is a pictorial of an R/C speed controller constructed according to the invention.
Figure 2:
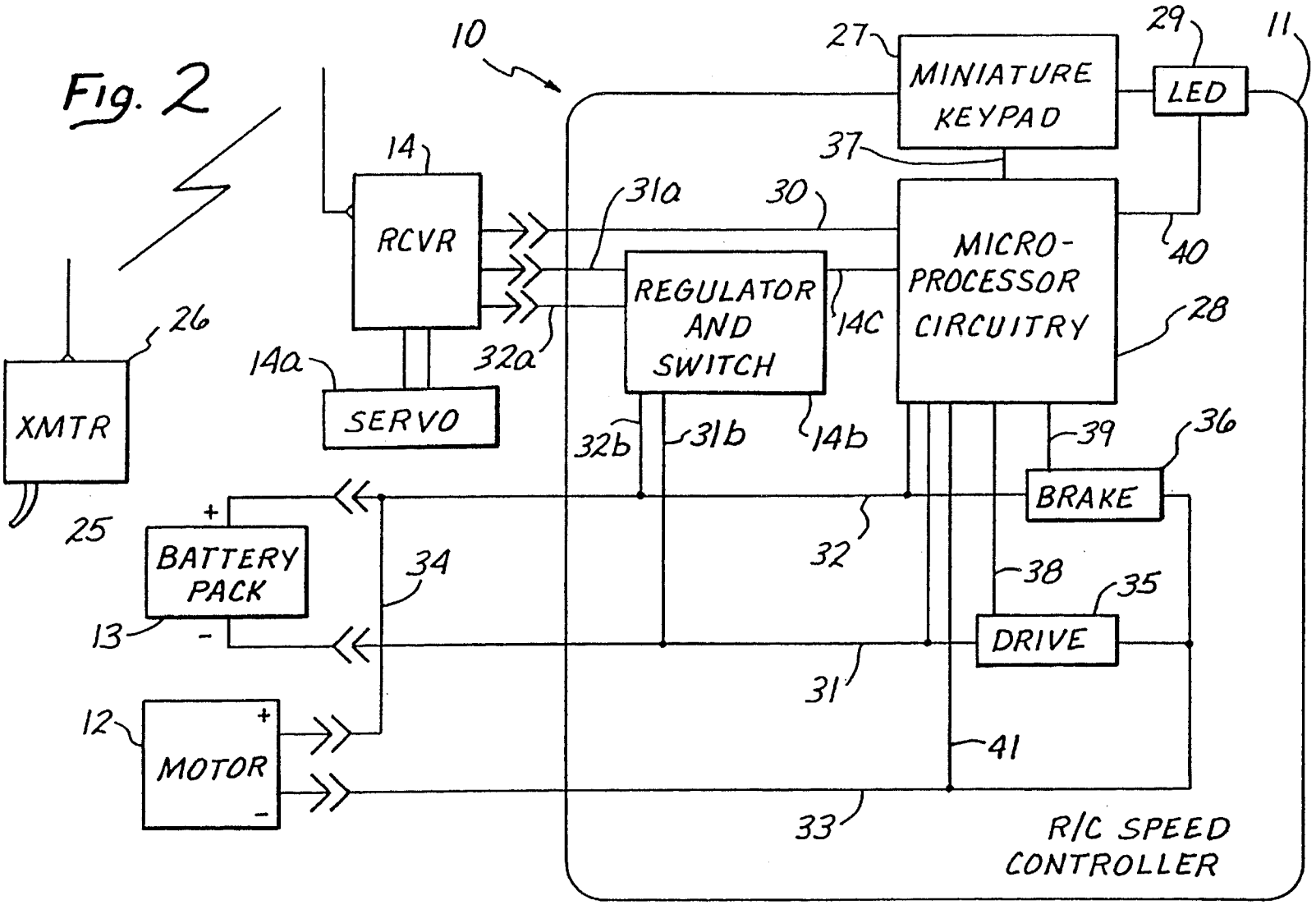
FIG. 2 is a block circuit diagram of the speed controller connected to a motor, a battery pack, and a receiver for operation in an R/C model car.

The drawings show one version of an R/C model speed controller 10 constructed according to the invention (FIG. 1) that combines with an R/C model receiver and an R/C model transmitter unit to form an R/C model control system constructed according to the invention (FIG. 2). The speed controller 10 is programmed to have a nonlinear response that compensates for drive motor characteristics, and it is similar in many respects to the speed controller described in U.S. Pat. No. 5,216,337. That patent is incorporated herein by reference for the details provided, and the following description proceeds with an overview of the R/C model componentry followed by further particulars of this invention.

Overview.

Generally, the speed controller 10 includes a module 11 (a housing) that houses and supports control circuitry (FIGS. 1 and 2). The module 11 is adapted to be mounted on a conventional R/C model (e.g., it may measure about 4.0 cm by 3.5 cm by 1.5 cm) and the control circuitry is miniaturized sufficiently to fit on/within the module 11. The module 11 may mount on the R/C model by known means (e.g., double-backed adhesive tape or screws) and it serves the function of housing and supporting the various electronic circuit components of the control circuitry.

Suitable wiring electrically connects the control circuitry to a drive motor (motor 12 in FIG. 1), a battery 13, and a receiver 14, and those components are mounted on an R/C model. An R/C model is not illustrated in the drawings, but it may take any of various known forms. The receiver 14 is adapted to be mounted on it, along with the speed controller 10 and the battery 13.

The receiver 14 connects in a known way with suitable cabling to a steering servo **14*a* on the R/C model. A wire 15 (FIG. 1 ) connects the control circuitry to one terminal of the battery 13 as depicted by a line 16. A wire 17 connects it to the other terminal of the battery 13 as depicted by a line 18. A wire 19 connects it to one terminal of the motor 12 as depicted by a line 20, and the other terminal of the motor 12 is connected to the same terminal of the battery 13 as depicted by a line 21**.

In addition, a three-wire cable 22 terminating in a connector 23 connects the control circuitry to the receiver 14 as depicted by a line 24 in FIG. 1. Two wires in the cable provide battery power to the receiver 14 while the third wire couples a signal from the receiver 14 to the control circuitry. Of course, the wires 15, 17, and. 19 may also include connectors, but some operators find it advantageous to solder those wires directly to terminals on the motor 12 and battery 13 for better conductivity and thereby better efficiency.

The speed controller 10 operates conventionally in some respects in the sense that it couples power from the battery 13 to the motor 12 according to speed and braking information received from the receiver 14. In other words, it changes the speed and braking of the motor 12 according to the speed and braking information. The receiver 14 sends the speed and braking information to the speed controller 10 according to speed and braking information it receives from a remote transmitter unit.

That arrangement enables an operator to remotely control the R/C model in which the controller 10 is installed by manipulating a throttle/brake trigger 25 on a transmitter unit 26 (FIG. 2). The R/C model transmitter unit 26 may take any of various forms, including, for example, the transmitter unit sold by Airtronics Inc. under the trademark CALIBER 3P. It is configured with the throttle/brake trigger 25 to produce proportional control signals. The trigger 25 is commonly referred to as a proportional control or setpoint input device, and it may include known potentiometer construction or other suitable means for inputting speed and braking setpoint information to the transmitter unit 26.

Manipulating the trigger 25 (or other moveable member arranged on the transmitter unit as a setpoint input device) enables the operator to input speed and braking setpoint information to the transmitter unit 26. The transmitter unit 26 responds to the position of the trigger 25 by transmitting corresponding speed and braking information to the speed controller 10 via the onboard receiver 14 and that results in the speed controller 10 controlling the motor 12 accordingly. Steering aspects of the R/C model stand apart from the inventive concepts herein disclosed, and so suffice it to say that the receiver 14 couples steering information to the steering servo 14*a*, and the steering servo 14*a* responds in a known way to control steering linkages on the R/C model.

The illustrated speed controller 10 includes a keypad 27 mounted on the module 11 (FIGS. 1 and 2). It combines with microprocessor circuitry 28 (FIG. 2) to facilitate operation by enabling convenient and repeatable direct entry of various operating parameters without the need to fine tune potentiometers. As a part of that operation, the speed controller 10 produces a visually discernible feedback signal with a light emitting diode illustrated as an LED 29. It also produces an audibly discernible feedback signal without using a conventional acoustic transducer by producing audible mechanical vibrations with high current pulses. Of course, those aspects of the illustrated speed controller 10 may vary without departing from the inventive concepts disclosed herein about a nonlinear overall trigger-to-speed-controller-output response.

Considering the control circuitry in further detail with reference to FIG. 2, it includes a receiver line 30 (connected to the third wire in the cable 22 of FIG. 1), positive and negative power lines 31*a* and 32*a* (also connected to the cable 22 in FIG. 1, first and second battery lines 31 and 32 (connected to the wires 15 and 17 in FIG. 1), and a motor line 33 (connected to the wire 19 in FIG. 1). Those are electrically conductive lines and they connect to the receiver 14, the motor 12, and the battery 13 by means of suitable wiring (e.g., with connectors or soldering).

The receiver line 30 connects in a conventional manner to a control-signal output of the receiver 14 over which throttle trigger setpoint information is sent to the control circuitry. The first and second battery lines 31 and 32 connect to first and second terminals of the battery 13. The also connect via lines 31*b* and 31*b* to a regulator and switch circuit 14*b*.

The circuit 14*b* includes suitable components to provide regulated 5.5 volts to the receiver 14 over the lines 31*a* and 32*a*. It also includes suitable components, such as a semiconductor switch, for example, for turning off power to the receiver 14 under control of the microprocessor circuitry 28. A line 14*c* couples a turnoff signal from the microprocessor circuitry 28 to the regulator and switch circuit 14*b* for that purpose. The motor line 33 connects to a first terminal of the motor 12, and a line 34 connects the second terminal of the motor 12 to the second terminal of the battery 13 (directly or by connection to the second battery line 32).

Figure 3:
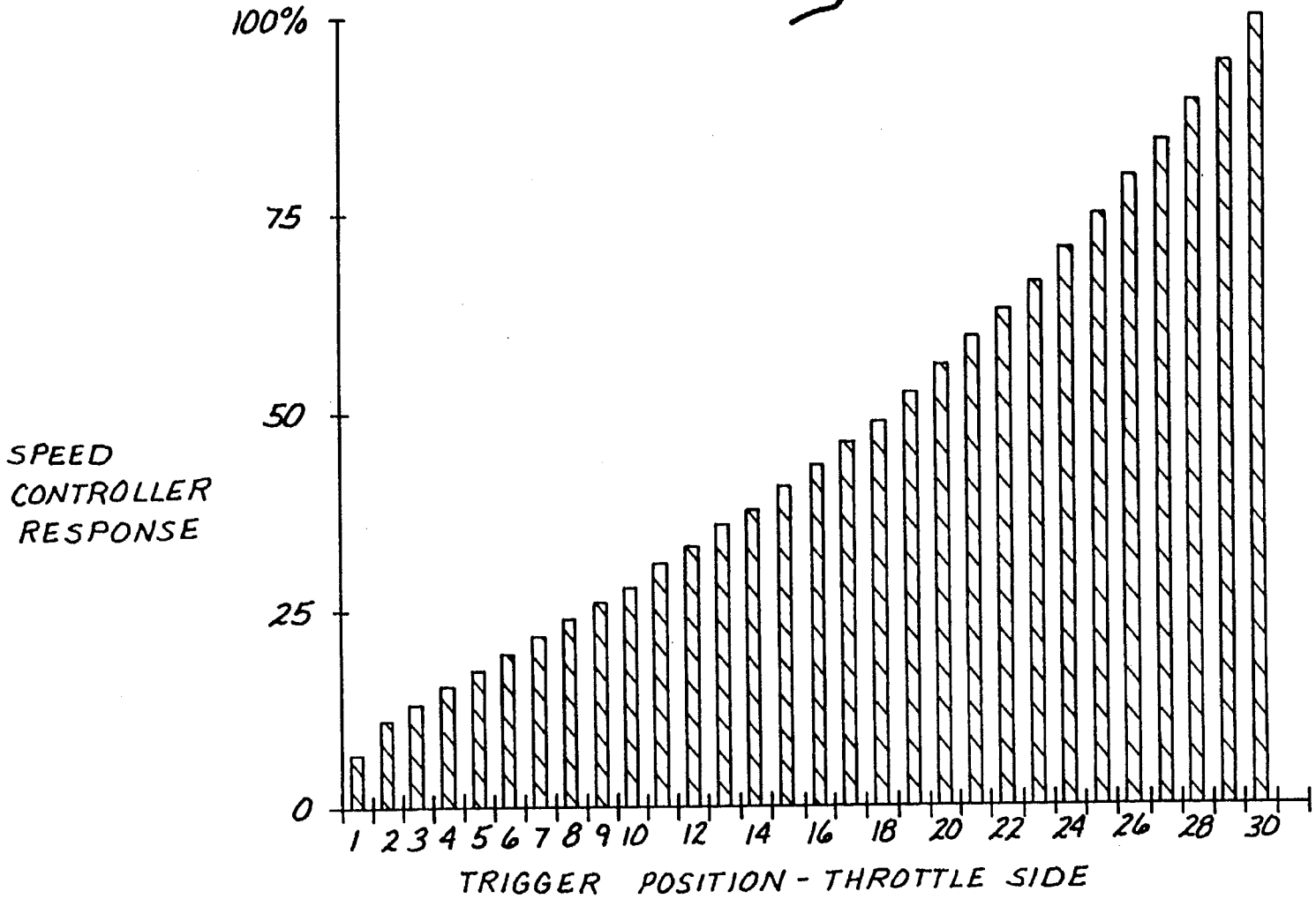
FIG. 3 is a bar graph showing the nonlinear response of the speed controller for various throttle/brake trigger positions on the throttle side of neutral.

The control circuitry includes a drive circuit 35 and a brake circuit 36 (FIG. 3). The drive circuit 35 is connected between the first battery line 31 and the motor line 33. There, it controls the flow of current between the battery 13 and the motor 12 by providing a switchable low impedance path. It switches under control of the microprocessor circuitry 28 between an ON state in which it couples the first battery line 31 to the motor line 33 and an OFF state in which it decouples the first battery line 31 from the motor line 33.

The brake circuit 26 is corrected between the motor line 33 and the second battery line 32. There, it facilitates deceleration of the motor 12 by providing a switchable low impedance path for flyback current. It switches under control of the microprocessor circuitry 28 between a first brake circuit state in which it couples the motor line 33 to the second battery line 32 and a second brake circuit state in which it decouples the second battery line 32 from the motor line 33.

The microprocessor circuitry 28 is coupled to the first and second battery lines 31 and 32 for power. It is coupled to the receiver line 30 for receiving the speed and braking information, and it is coupled by a line 37 to the keypad 27 in order to respond to keypad entries. A control line 38 couples a drive circuit control signal from the microprocessor circuitry 28 to the drive circuit 35, a control line 39 couples a brake circuit control signal to the brake circuit 36, and a control line 40 couples power under microprocessor control to the LED 29. In addition, a line 41 connects the motor line 33 to the microprocessor circuitry 28 so that the microprocessor can monitor the voltage on that line.

Interconnected that way, the microprocessor circuitry 28 performs the function of switching the drive circuit 35 and the brake circuit 36 under program control according to speed and braking information received on the receiver line 30. For that purpose, the microprocessor circuitry 28 includes suitable digital circuitry (e.g., a microprocessor or microcontroller and known associated componentry). It may include, for example, a central processor, memory, input and output circuitry, power supply components, a clock, an analog-to-digital converter, and any of other various known analog and digital components configured according to known techniques to perform as subsequently described. In addition, it includes programming configured according to known programming techniques to perform as described.

The individual components and the precise programming employed in the illustrated embodiment for drive and brake control are not specified in further detail. Those things are well within the capabilities of one of ordinary skill in the art based upon available literature, known techniques, and the descriptions provided. The precise configuration may vary significantly according to individual preferences. By way of example, however, the microprocessor circuitry 28 may include the microcontroller chip available from Motorola that is identified by part number 68HC705P9, as well as known associated componentry, and it may be programmed using known techniques to function as described.

The line 38 couples the drive circuit control signal from the microprocessor circuitry 28 to the drive circuit 35, and the line 39 couples the brake circuit control signal from the microprocessor circuitry 28 to the brake circuit 36. The microprocessor circuitry 26 is programmed to produce the drive circuit control signal and the brake circuit control signal according to speed and braking information received on the receiver line 30 in order to switch the drive circuit 35 and the brake circuit 36 at the appropriate times to cause the motor 12 to operate as desired.

The speed and braking information reflects the position of the throttle/brake trigger 25 and so it indicates desired motor speed and braking. The speed and braking information varies over a range of extending from a high or maximum brake circuit endpoint value (throttle/brake trigger 25 pushed fully forward, on a brake side of neutral to a MAXIMUM braking setpoint position) to a high or maximum drive circuit endpoint value (throttle/brake trigger 25 pulled fully rearward on a throttle side of neutral to a MAXIMUM speed setpoint position). Intermediate those endpoints is a neutral value (zero speed and zero braking) corresponding to the throttle/brake trigger 25 being in the neutral position intermediate the fully forward and fully rearward positions (the throttle trigger 25 is spring biased in that neutral position).

Thus, the throttle/brake trigger 25 (or other moveable member) enables an operator to input the speed and braking setpoint information to the transmitter unit. It is constructed so that the operator can move it from the neutral position (representing zero speed and no braking) through a range of speed setpoint positions on the throttle side of neutral beginning with a near zero or INITIAL speed setpoint position immediately adjacent neutral, to a SECOND speed setpoint position just beyond the INITIAL position and ending in the MAXIMUM speed setpoint position furthest from neutral. The operator can also move it from the neutral position through a range of braking setpoint positions on the brake side of neutral beginning with a near zero or INITIAL braking setpoint position immediately adjacent neutral, to a SECOND braking setpoint position just beyond the INITIAL position, and ending in the MAXIMUM braking setpoint position furthest from neutral.

To operate the motor, the microprocessor circuitry 28 cycles the drive circuit 35 between the ON state and the OFF state in a series of cycles at a predetermined rate (e.g., 3 KHz) and a variable drive circuit duty ratio so that the instantaneous drive circuit duty ratio corresponds to (follows) the speed information received from the receiver 14. The drive circuit duty ratio for a particular cycle is the ratio of time the drive circuit 35 is in the ON state to the sum of that time and the time it is in the OFF state. When the operator pulls the throttle trigger 25 rearwardly just slightly from the neutral position to the INITIAL speed setpoint position, the microprocessor circuitry 28 cycles the drive circuit at a low-end drive circuit duty ratio (e.g., a duty cycle ratio of six percent, corresponding to about 20 microseconds in the ON state). The microprocessor circuitry 28 starts at six percent or so, because a drive circuit duty ratio below that does not normally produce sufficient torque in the motor. As the throttle trigger 25 is pulled further rearwardly to the fully rearward MAXIMUM speed setpoint position, the microprocessor circuitry 28 increases the duty ratio accordingly, to a maximum value for the MAXIMUM speed setpoint position of the throttle/brake trigger 25. Normal motor operation (i.e., sufficient torque to drive the model car wheels) occurs between those points.

The drive circuit 35 includes one or more semiconductor devices capable of switching the current supplied by the battery 13 to the motor 12. It may use, liar example, a bank of several parallel-connected MOSFET devices, such as those available from Siliconix that are identified by part number SMP60N05. The drive circuit 35 is conventional in some respects in the sense that it operates to switch current flowing between the battery 13 and the motor 12, but it does so under program control according to information inputted with the keypad 27. It switches the drive circuit 35 under program control to cause pulses of current of desired duration and repetition rate to flow to the motor 12. The microprocessor circuitry 28 varies the duration and repetition rate to achieve the desired current flow. In that way, it controls the flow of battery power to the motor 12 and thereby controls motor operation accordingly.

The brake circuit 36 includes one or more semiconductor devices for shorting the motor terminals together for braking purposes. They are capable of switching the amount of current that flows. The illustrated brake circuit 36 employs two parallel-connected MOSFET devices, such as the Siliconix SMP60N05 devices previously described for the drive circuit 35. The brake circuit 36 is conventional in some respects in that it operates to decelerate the motor 12. It provides a switchable low impedance path between the motor terminals. However, it does so under program control. The microprocessor circuitry 28 switches the brake circuit 36 to the first brake circuit state to load the motor 12 and thereby decelerate it. It switches the brake circuit 36 in a series of cycles at a predetermined rate (e.g., 3 KHz) and a variable brake circuit duty ratio so that the instantaneous brake circuit duty ratio corresponds to (follows) the braking information received from the receiver 14. In the absence of the low impedance path provided by the brake circuit 36, the motor 12 freewheels when the drive circuit 35 is in the OFF state and only coasts to a stop.

Further Particulars.

Thus, the illustrated R/C model control system includes a speed controller 10 for changing the speed and braking of a drive motor of the model according to speed and braking information sent to the speed controller 10. It includes a receiver unit 14 operationally interconnected with the speed controller 10 for sending the speed and braking information to the speed controller 10 according to speed and braking information received by the receiver 14. And it includes a transmitter unit 26 for transmitting the speed and braking information to the receiver 14 according to speed and braking setpoint information inputted to the transmitter unit 14 by an operator with a moveable member on the transmitter unit (i.e., the throttle/brake trigger 25).

According to a major aspect of the invention, at least one of the transmitter unit 26, the receiver unit 14, and the speed controller 10 is arranged to produce a nonlinear speed controller response to changes in the position of the moveable member 25. In other words, at least one of those components is arranged so that the response of the drive circuit and the brake circuit to movement of the trigger 25 is nonlinear in a manner that compensates for the characteristics of the motor 12. It is arranged to do so in the sense that it is constructed with suitable components that may be designed and interconnected by one of ordinary skill in the art according to known techniques to function as described.

Preferably, the speed controller 10 is outfitted as described with programmable microprocessor circuitry for that purpose, although the transmitter unit and/or the receiver unit of various other embodiments not shown herein are arranged to produce the nonlinear response described instead. Furthermore, non-microprocessor digital circuitry and even non-digital circuitry may be employed without departing from the broader inventive concepts disclosed. From the foregoing and subsequent descriptions, one of ordinary skill in the art can provide the necessary programming and circuit elements to perform the functions described, and so complete programming and circuit details are not described here.

The speed controller response (drive circuit and brake circuit response) is nonlinear in reference to movement of the trigger 25. For purposes of describing the nonlinear relationship, the trigger 25 may be said to be moveable from the neutral position through the range of speed setpoint positions previously mentioned, beginning at the INITIAL speed setpoint position near the neutral position, to the SECOND speed setpoint position, and continuing to the MAXIMUM speed setpoint position further from the neutral position. In addition, it is moveable from the neutral position through the range of braking setpoint positions previously mentioned, beginning at the INITIAL braking setpoint position near the neutral position, to the SECOND braking setpoint position, and continuing to the MAXIMUM braking setpoint position further from the neutral position.

In the illustrated R/C model control system, the microprocessor circuitry 28 of the speed controller 10 is programmed to produce the desired nonlinear response. It is programmed so that the speed controller responds to an incremental increase in speed setpoint position of the trigger 25 near the neutral position but beyond the SECOND speed setpoint position with a smaller incremental increase in drive circuit duty ratio than when the speed controller responds to such an incremental increase in speed setpoint position near the MAXIMUM speed setpoint position. In addition, it is programmed so that the speed controller responds to an incremental increase in braking setpoint position of the trigger 25 near the neutral position but beyond the SECOND braking setpoint position with a greater incremental increase in brake circuit duty ratio than when the speed controller responds to such an incremental increase in braking setpoint position near the MAXIMUM braking setpoint position.

Figure 4:
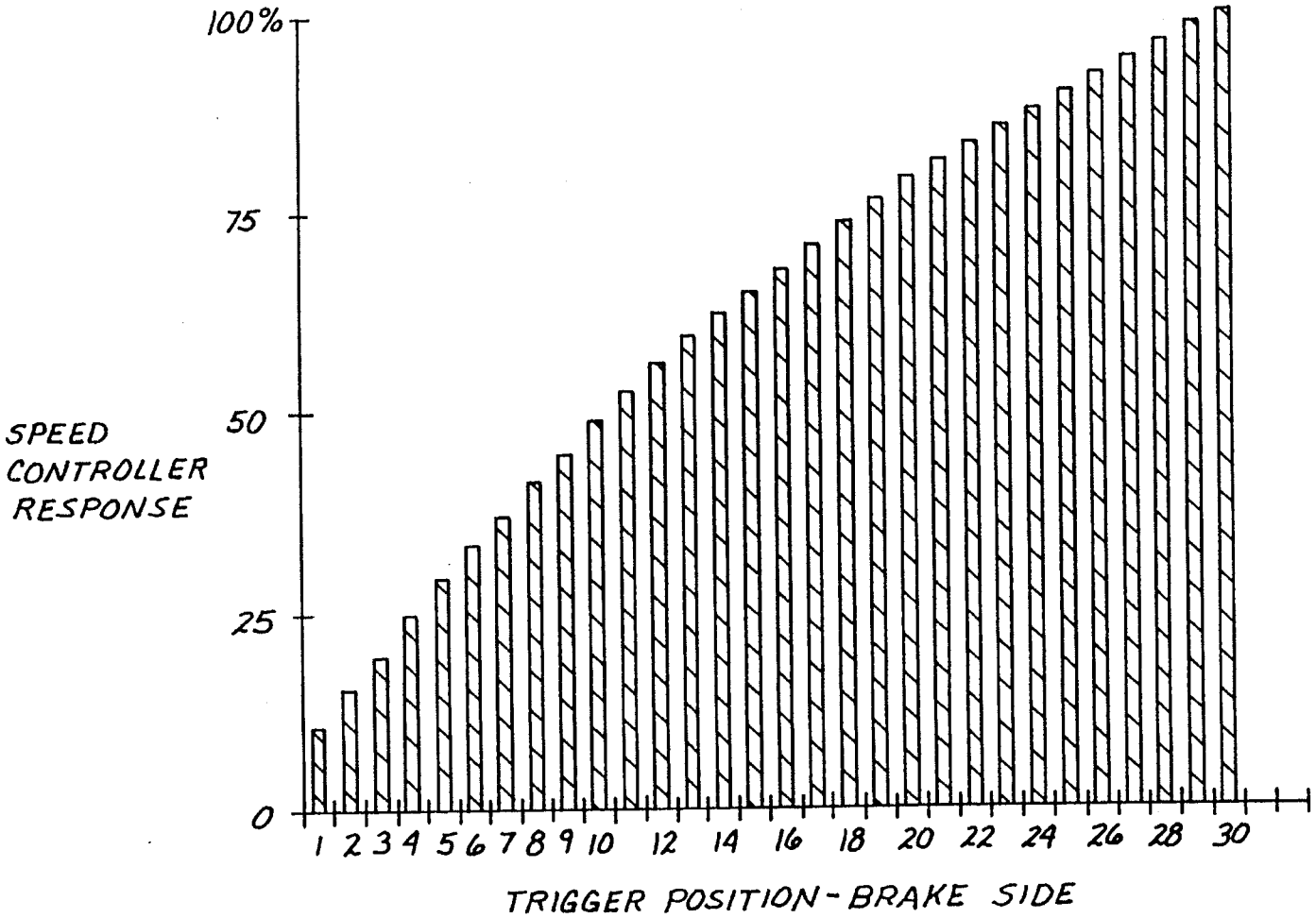
FIG. 4 is a bar graph showing the nonlinear response of the speed controller for various throttle/brake trigger positions on the brake side of neutral.

FIGS. 3 and 4 combine with TABLE A through TABLE F to further illustrated the nonlinear response. First consider FIG. 3 and the corresponding tabulation of values in TABLE A through TABLE C. FIG. 3 is a bar graph of speed controller response (i.e., drive circuit duty ratio) for a range of thirty uniformly spaced apart trigger positions on the throttle side of neutral (i.e., speed setpoint positions of the trigger 25). Of course, trigger excursion on the throttle side may be divided into fewer or greater than thirty trigger positions to represent the same number of different speeds without departing from the inventive concepts disclosed. The intersection of the vertical or y-axis (the ordinate) and the horizontal or x-axis (the abscissa) represents the neutral position of the trigger 25. The trigger position on the horizontal axis labelled with a figure "1" represents the INITIAL speed setpoint position, the trigger position labelled "2" represents the SECOND speed setpoint position, the trigger position labelled "30" represents the MAXIMUM speed setpoint position, and those labelled "3" through "29" represent the INTERMEDIATE speed setpoint positions.

Looking at the relative size of the bars in FIG. 3 immediately suggests the nonlinear speed response described, and the following TABLE A through TABLE C provide the figures. TABLE A tabulates the drive circuit duty ratio and the incremental increase in drive circuit duty ratio for each trigger position in a lower portion of the range of speed setpoint positions. The drive circuit duty ratio is expressed as a percentage of a reference drive circuit duty ratio value resulting in a maximum motor speed.

An average incremental increase of 2.81% over the first ten trigger positions may be calculated from the data tabulated in TABLE A (28.1% total increase from neutral to trigger position 10 divided by 10 trigger positions). If the 7.0% initial incremental increase is not included in the calculation, an average incremental increase of 2.34% results for the nine trigger positions 2 through 10 (21.1 divided by 9 positions). If the 4.3% low-speed incremental increase is not included in the calculation, an average incremental increase of 2.1% results (16.8% divided by 8 positions). The incremental increases for the first and second trigger positions are relatively large because a somewhat large increase in drive circuit duty ratio is required initially to develop sufficient torque to start a drive motor rotating.

TABLE A

| LOWER SPEED SETPOINT POSITIONS | | |
|---|---|---|
| Trigger Position | Drive Circuit Duty Ratio | Incremental Increase |
| 1 | 7.0% | 7.0% |
| 2 | 11.3 | 4.3 |
| 3 | 13.3 | 2.0 |
| 4 | 15.6 | 2.3 |
| 5 | 17.9 | 2.3 |
| 6 | 19.9 | 2.0 |
| 7 | 21.9 | 2.0 |
| 8 | 24.2 | 2.3 |
| 9 | 26.2 | 2.0 |
| 10 | 28.1 | 1.9 |

TABLE B tabulates the drive circuit duty ratio and the incremental increase for each trigger position in a middle portion of the range of speed setpoint positions. An average incremental increase of 2.81% may be calculated over the middle portion (28.1% total increase from position 10 to position 20 divided by 10 trigger positions).

TABLE B

| MIDDLE SPEED SETPOINT POSITIONS | | |
|---|---|---|
| Trigger Position | Drive Circit Duty Ratio | Incremental Increase |
| 11 | 31.2% | 3.1% |
| 12 | 33.6 | 2.8 |
| 13 | 36.4 | 2.8 |
| 14 | 37.9 | 1.5 |
| 15 | 40.6 | 2.7 |
| 16 | 43.7 | 3.1 |
| 17 | 46.1 | 2.4 |
| 18 | 49.2 | 3.1 |
| 19 | 52.3 | 3.1 |
| 20 | 56.2 | 3.9 |

Similarly, TABLE C tabulates the drive circuit duty ratio and the incremental increase for each trigger position in an upper portion of the range of speed setpoint positions. An average incremental increase of 4.38% may be calculated from the data presented for the upper portion (4.38% total increase from position 20 to position 30 divided by 10 positions).

TABLE C

| UPPER SPEED SETPOINT POSITIONS | | |
|---|---|---|
| Trigger Position | Drive Circuit Duty Ratio | Incremental Increase |
| 21 | 59.8% | 3.6% |
| 22 | 63.3 | 3.5 |
| 23 | 66.8 | 3.5 |
| 24 | 71.1 | 4.3 |
| 25 | 75.0 | 3.9 |
| 26 | 80.4 | 5.4 |
| 27 | 84.8 | 4.4 |
| 28 | 89.9 | 5.1 |
| 29 | 94.2 | 4.3 |
| 30 | 100.0 | 5.8 |

Now consider FIG. 4 and TABLE D through TABLE F. FIG. 4 is a bar graph similar to FIG. 3 that shows speed controller response (i.e., brake circuit duty ratio) for a range of thirty uniformly spaced apart trigger positions on the brake side of neutral (i.e., braking setpoint positions of the trigger 25). As on the throttle side, trigger excursion on the brake side may be divided into fewer or greater than thirty trigger positions to represent the same number of different amounts of braking without departing from the inventive concepts disclosed. The intersection of the vertical or y-axis (the ordinate) and the horizontal or x-axis (the abscissa) represents the neutral position of the trigger 25. The trigger position on the horizontal axis labelled with a figure "1" represents the INITIAL braking setpoint position, the trigger position labelled "2" represents the SECOND braking setpoint position, the trigger position labelled "30" represents the MAXIMUM braking setpoint position, and those labelled "3" through "29" represent the INTERMEDIATE braking setpoint positions.

The relative size of the bars in FIG. 4 suggests the nonlinear braking response, and TABLE D through TABLE E provide the figures. TABLE D tabulates the brake circuit duty ratio and the incremental increase in brake circuit duty ratio for each trigger position in a lower portion of the range of braking setpoint positions. The brake circuit duty ratio is expressed as a percentage of a reference brake circuit duty ratio value resulting in maximum braking. An average incremental increase of 4.94% over the first ten trigger positions may be calculated from data tabulated in TABLE D (49.4% total increase from neutral to position 10 divided by 10 trigger positions).

TABLE D

LOWER BRAKING SETPOINT POSITIONS

| Trigger Position | Brake Circuit Duty Ratio | Incremental Increase |
|---|---|---|
| 1 | 10.4% | 10.4% |
| 2 | 15.5 | 5.1 |
| 3 | 20.4 | 4.9 |
| 4 | 24.7 | 4.3 |
| 5 | 29.4 | 4.7 |
| 6 | 33.9 | 4.5 |
| 7 | 37.0 | 3.1 |
| 8 | 41.3 | 4.3 |
| 9 | 44.8 | 3.5 |
| 10 | 49.4 | 4.6 |

TABLE E tabulates the brake circuit duty ratio and the incremental increase for each trigger position in a middle portion of the range of braking setpoint positions, with a 3.02% average incremental increase (30.2% total increase from position 10 to position 20 divided by 10 positions).

TABLE E

MIDDLE BRAKING SETPOINT POSITIONS

| Trigger Position | Brake Circuit Duty Ratio | Incremental Increase |
|---|---|---|
| 11 | 52.9% | 3.5% |
| 12 | 56.4 | 3.5 |
| 13 | 60.2 | 3.8 |
| 14 | 62.5 | 2.3 |
| 15 | 65.6 | 3.1 |
| 16 | 68.3 | 2.7 |
| 17 | 71.0 | 2.7 |
| 18 | 74.1 | 3.1 |
| 19 | 76.8 | 2.7 |
| 20 | 79.6 | 2.8 |

TABLE F tabulates the brake circuit duty ratio and the incremental increase in an upper portion, with a 2.04% average incremental increase (20.4% total increase from position 20 to position 30 divided by 10 positions).

TABLE F

UPPER BRAKING SETPOINT POSITIONS

| Trigger Position | Brake Circuit Duty Ratio | Incremental Increase |
|---|---|---|
| 21 | 81.9% | 2.3% |
| 22 | 83.8 | 1.9 |
| 23 | 86.1 | 2.3 |
| 24 | 88.0 | 1.9 |
| 25 | 90.4 | 2.4 |
| 26 | 92.3 | 1.9 |
| 27 | 94.6 | 2.3 |
| 28 | 96.9 | 2.3 |
| 29 | 98.9 | 2.0 |
| 30 | 100.0 | 1.1 |

Thus, the invention provides an R/C model control system with a nonlinear trigger-to-controller-output response that compensates for the characteristics of the drive motor. It decreases sensitivity of the throttle/brake trigger near the neutral on the throttle side while increasing sensitivity near neutral on the brake side. As a result, the operator need not continually compensate for trigger sensitivity as he rapidly pulls and pushes on the throttle/brake trigger. He is less likely to spin the wheels while increasing speed. He is less likely to lock the wheels during braking. And speed changes become more linearly related to trigger movement for improved maneuverability.

The nonlinear response is accomplished by arranging the control system (i.e., at least one of the transmitter, the receiver, and the speed controller) so that the overall trigger-to-drive-motor-output response is more linear than is common with existing control systems. A preferred embodiment does so with a suitably programmed speed controller that varies drive circuit duty ratio and brake circuit duty ratio in the desired manner according to throttle/brake trigger position.

Although an exemplary embodiment has been shown and described, one of ordinary skill in the art may make many changes, modifications, and substitutions without necessarily departing from the spirit and scope of the invention.

What is claimed is:

1. A control system for a radio controlled model, comprising:

means in the form of a speed controller for changing the speed and braking of a drive motor of the model according to speed and braking information sent to the speed controller, the speed controller having means in the form of a drive circuit operable at a variable drive circuit duty ratio for changing the speed of a drive motor of the model, means in the form of a brake circuit operable at a variable brake circuit duty ratio for changing the braking of the model, and means in the form of a control circuit for changing the drive circuit duty ratio and the brake circuit duty ratio according to the speed and braking information;

means in the form of a receiver unit operationally interconnected with the speed controller for sending the speed and braking information to the speed controller according to speed and braking information received by the receiver; and means in the form of a transmitter unit for transmitting the speed and braking information to the receiver according to speed and braking setpoint information inputted to the transmitter unit by an operator;

the transmitter unit including means in the form of a moveable member for enabling an operator to input the speed and braking setpoint information to the transmitter unit;

the moveable member being moveable from a neutral position through a range of speed setpoint positions beginning at an INITIAL speed setpoint position near the neutral position, to a SECOND speed setpoint position just beyond the INITIAL speed setpoint position, and continuing to a MAXIMUM speed setpoint position further from the neutral position;

the moveable member being moveable from the neutral position through a range of braking setpoint positions beginning at an INITIAL braking setpoint position near the neutral position, to a SECOND braking setpoint position just beyond the INITIAL braking setpoint position, and continuing to a MAXIMUM braking setpoint position further from the neutral position; and at least one of the speed controller, the receiver, and the transmitter unit being arranged to provide decreased sensitivity of the control system to changes in speed setpoint position of the moveable member near the neutral position and increased sensitivity of the control system to changes in braking setpoint position near the neutral position in the sense that at least one of the speed controller, the receiver, and the transmitter unit is arranged to produce a nonlinear speed controller response to changes in the position of the moveable member such that (i) the speed controller responds to an incremental increase in speed setpoint position of the moveable member over a lower 10% of the range of speed setpoint positions with a smaller incremental increase in drive circuit duty ratio than when the speed controller responds to such an incremental increase in speed setpoint position over an upper 10% of the range of speed setpoint positions, and (ii) the speed controller responds to an incremental increase in braking setpoint position of the moveable member over a lower 10% portion of the range of braking setpoint positions with a greater incremental increase in brake circuit duty ratio than when the speed controller responds to such an incremental increase in braking setpoint position over an upper 10% portion of the range of braking setpoint positions.

2. A control system as recited in claim 1, wherein at least one of the speed controller, the receiver, and the transmitter unit is arranged to produce a nonlinear speed controller response to changes in the position of the moveable member such that the speed controller responds to an incremental increase in speed setpoint position of the moveable member over a lower 25% of the range of speed setpoint positions that begins near the neutral position with a smaller incremental increase in drive circuit duty ratio than when the speed controller responds to such an incremental increase in speed setpoint position over an upper 25% of the range of speed setpoint positions that ends with the MAXIMUM speed setpoint position.

3. A control system as recited in claim 1, wherein at least one of the speed controller, the receiver, and the transmitter unit is arranged to produce a nonlinear speed controller response to changes in the position of the moveable member such that the speed controller responds to an incremental increase in braking setpoint position of the moveable member over a lower 25% portion of the range of braking setpoint positions that begins near the neutral position with a greater incremental increase in brake circuit duty ratio than when the speed controller responds to such an incremental increase in braking setpoint position over an upper 25% portion of the range of braking setpoint positions that ends with the MAXIMUM braking setpoint position.

4. A control system as recited in claim 1, wherein the speed controller includes programmable control circuitry that is programmed to produce the nonlinear speed controller response.

5. A control system for a radio controlled model, comprising:

means in the form of a speed controller for changing the speed and braking of a drive motor of the model according to speed and braking information sent to the speed controller, the speed controller having means in the form of a drive circuit operable at a variable drive circuit duty ratio for changing the speed of a drive motor of the model, means in the form of a brake circuit operable at a variable brake circuit duty ratio for changing the braking of the model, and means in the form of a control circuit for changing the drive circuit duty ratio and the brake circuit duty ratio according to the speed and braking information;

means in the form of a receiver unit operationally interconnected with the speed controller for sending the speed and braking information to the speed controller according to speed and braking information received by the receiver; and means in the form of a transmitter unit for transmitting the speed and braking information to the receiver according to speed and braking setpoint information inputted to the transmitter unit by an operator;

the transmitter unit including means in the form of a moveable member for enabling an operator to input the speed and braking setpoint information to the transmitter unit;

the moveable member being moveable from a neutral position through a range of speed setpoint positions beginning at an INITIAL speed setpoint position near the neutral position, to a SECOND speed setpoint position just beyond the INITIAL position, and continuing to a MAXIMUM speed setpoint position further from the neutral position;

the moveable member being moveable from the neutral position through a range of braking setpoint positions beginning at an INITIAL braking setpoint position near the neutral position, to a SECOND braking setpoint position just beyond the INITIAL position, and continuing to a MAXIMUM braking setpoint position further from the neutral position; and at least one of the speed controller, the receiver, and the transmitter unit being arranged to provide decreased sensitivity of the control system to changes in speed setpoint position of the moveable member near the neutral position and increased sensitivity of the control system to changes in braking setpoint position near the neutral position in the sense that at least one of the speed controller, the receiver, and the transmitter unit is arranged to produce a nonlinear speed controller response to changes in the position of the moveable member such that (i) the average incremental increase in drive circuit duty ratio for an incremental increase in speed setpoint position over a lower 30% portion of the range of speed setpoint positions that begins beyond the SECOND speed setpoint position is less than the average incremental increase in drive circuit duty ratio for an incremental increase in speed setpoint position over an upper 30% portion of the range of speed setpoint positions that includes the MAXIMUM speed setpoint position, and (ii) the average incremental increase in brake circuit duty ratio for an incremental increase in braking setpoint position over a lower 30% portion of the range of brake setpoint positions that includes the SECOND braking setpoint position is greater than the average incremental increase in brake circuit duty ratio for an incremental increase in braking setpoint position over an upper 30% portion of the range of braking setpoint positions that includes the MAXIMUM braking setpoint position.

6. A control system as recited in claim 5, wherein the speed controller includes programmable control circuitry that is programmed to produce the nonlinear speed controller response.

7. A speed controller, comprising:

a motor line and first and second battery lines;

means in the form of a drive circuit connected between the first battery line and the motor line for switching between an ON state in which the drive circuit couples the first battery line to the motor line and an OFF state in which the first battery line is decoupled from the motor line;

means in the form of a brake circuit connected between the second battery line and the motor line for switching between a first brake circuit state in which the brake circuit couples the second battery line to the motor line and a second brake circuit state in which the second battery line is decoupled from the motor line;

means in the form of control circuitry connected to the receiver line, the drive circuit, and the brake circuit for switching the drive circuit under program control between the ON state and the OFF state at a drive circuit duty ratio corresponding to speed information received by the control circuit from a receiver connected to the receiver line and for switching the brake circuit between the first brake circuit state and the second brake circuit state at a brake circuit duty ratio corresponding to braking information received by the control circuit from the receiver;

the control circuitry being programmed to provide decreased sensitivity of the control system to changes in the speed information for lower speeds and increased sensitivity of the control system to changes in the braking information for lower braking rates in the sense that:

(i) the control circuitry is programmed to respond to speed information representing an incremental increase in speed over a lower 25% portion of a range of motor speeds with a smaller incremental increase in drive circuit duty ratio than when the speed controller responds to speed information representing such an incremental increase in speed over an upper 25% portion of the range of motor speeds; and (ii) the control circuitry is programmed to respond to braking information representing an incremental increase in braking information over a lower 25% portion of a range of braking rates with a larger incremental change in brake circuit duty ratio than when the speed controller responds to braking information representing such an incremental increase in braking over an upper 25% portion of the range of braking rates.

8. A method of controlling the speed and braking of a drive motor of a radio controlled model, comprising:

providing a control system having means in the form of a moveable member for enabling an operator to input the speed and braking setpoint information, means in the form of a drive circuit operable at a variable drive circuit duty ratio for changing the speed of a drive motor of the model, means in the form of a brake circuit operable at a variable brake circuit duty ratio for changing the braking of the model, and means in the form of a control circuit for changing the drive circuit duty ratio and the brake circuit duty ratio according to the speed and braking information, the moveable member being moveable from a neutral position through a range of speed setpoint positions beginning at an INITIAL speed setpoint position near the neutral position, to a SECOND setpoint position just beyond the INITIAL position, and continuing to a MAXIMUM speed setpoint position further from the neutral position, and the moveable member being moveable from the neutral position through a range of braking setpoint positions beginning at an INITIAL braking setpoint position near the neutral position, to a SECOND braking setpoint position, and continuing to a MAXIMUM braking setpoint position further from the neutral position;

at least partially compensating for the characteristics of the drive motor with the control system so that the control system provides decreased sensitivity to changes in the speed setpoint position near the neutral position and increased sensitivity to changes in braking setpoint position near the neutral position in the sense that:

(i) the control system responds to an incremental increase in speed setpoint position of the moveable member near the neutral position but beyond the SECOND speed setpoint position with a smaller incremental increase in drive circuit duty ratio than when the speed controller responds to such an incremental increase in speed setpoint position near the MAXIMUM speed setpoint position; and (ii) the control system responds to an incremental increase in braking setpoint position of the moveable member near the neutral position but beyond the INITIAL braking setpoint position with a greater incremental increase in brake circuit duty ratio than when the speed controller responds to such an incremental increase in braking setpoint position near the MAXIMUM braking setpoint position.

9. A method as recited in claim 8, further comprising the step of at least partially compensating for the characteristics of the drive motor with the control system so that the average incremental increase in drive circuit duty ratio for an incremental increase in speed setpoint position over a lower 25% portion of the range of speed setpoint positions is less than the average incremental increase in drive circuit duty ratio for such an incremental increase in speed setpoint position over an upper 25% of the range of speed setpoint positions.

10. A method as recited in claim 8, further comprising the step of at least partially compensating for the characteristics of the drive motor with the control system so that the average incremental increase in brake circuit duty ratio for an incremental increase in braking setpoint position over a lower 25% portion of the range of brake setpoint positions is greater than the average incremental increase in brake circuit duty ratio for such an incremental increase in braking setpoint position over an upper 25% portion of the range of braking setpoint positions.

11. A method as recited in claim 8, wherein the speed controller has a programmable control circuitry that is programmed to produce the response described.

* * * * *